US010907413B1

(12) United States Patent
Drenth et al.

(10) Patent No.: US 10,907,413 B1
(45) **Date of Patent: *Feb. 2, 2021**

(54) CONTINUOUS SAMPLING DRILL BIT

(71) Applicant: BLY IP INC., Salt Lake City, UT (US)

(72) Inventors: Christopher L. Drenth, Burlington (CA); Robert Andrew Corona, Salt Lake City, UT (US)

(73) Assignee: BLY IP INC., Salt Lake City, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/813,135

(22) Filed: Mar. 9, 2020

Related U.S. Application Data

(63) Continuation of application No. 16/544,333, filed on Aug. 19, 2019, now Pat. No. 10,626,676.

(51) Int. Cl.

| | |
|---|---|
| ***E21B 10/04*** | (2006.01) |
| ***E21B 10/60*** | (2006.01) |
| ***E21B 10/00*** | (2006.01) |
| ***E21B 10/20*** | (2006.01) |
| ***E21B 10/02*** | (2006.01) |
| ***E21B 10/08*** | (2006.01) |
| ***E21B 49/02*** | (2006.01) |
| *E21B 49/08* | (2006.01) |
| *E21B 10/62* | (2006.01) |
| *E21B 10/48* | (2006.01) |

(52) U.S. Cl.
CPC ..... *E21B 10/04* (2013.01); *E21B 10/00* (2013.01); *E21B 10/02* (2013.01); *E21B 10/08* (2013.01); *E21B 10/20* (2013.01); *E21B 10/605* (2013.01); *E21B 49/02* (2013.01); *E21B 10/48* (2013.01); *E21B 10/62* (2013.01); *E21B 49/084* (2013.01)

(58) Field of Classification Search
CPC ..... E21B 10/00; E21B 10/02; E21B 10/04; E21B 10/08; E21B 10/20; E21B 10/48; E21B 10/605; E21B 10/62; E21B 3/00; E21B 7/00
See application file for complete search history.

(56) References Cited

U.S. PATENT DOCUMENTS

| | | | |
|---|---|---|---|
| 2,585,386 | A | 2/1952 | Hendrickson |
| 4,694,916 | A | 9/1987 | Ford |
| 9,279,292 | B2 | 3/2016 | Pearce et al. |
| 9,637,980 | B2 | 5/2017 | Lambert et al. |

(Continued)

FOREIGN PATENT DOCUMENTS

| | | | | |
|---|---|---|---|---|
| WO | WO-2018116140 | A1 * | 6/2018 | ..... E21B 10/36 |
| WO | WO-2018/152089 | A1 | 8/2018 | |

*Primary Examiner* — Tara Schimpf
(74) *Attorney, Agent, or Firm* — Ballard Spahr LLP

(57) ABSTRACT

A drill bit comprises a first and a second body received within the first body. Each of the first body and second body has a respective crown, each crown having an inner and an outer operative circumference. The outer operative circumference of the second body and the inner operative circumference of the first body can define a first volume that can receive a tubular core sample. The second body can define a break surface that breaks the tubular core sample into core pieces. The drill bit can be employed in a borehole with a reverse circulation system that pumps fluid around an outer surface of the bit, and returning fluid can carry the core pieces out of the borehole.

15 Claims, 12 Drawing Sheets

(56) References Cited

U.S. PATENT DOCUMENTS

| | | | | |
|---|---|---|---|---|
| 2012/0061146 | A1* | 3/2012 | Pearce | E21B 10/26 175/58 |
| 2016/0061146 | A1 | 3/2016 | Werquin | |
| 2017/0362900 | A1* | 12/2017 | Pearce | E21B 10/02 |

* cited by examiner

CONTINUOUS SAMPLING DRILL BIT

CROSS-REFERENCE TO RELATED APPLICATION

This application is a continuation of U.S. patent application Ser. No. 16/544,333, filed Aug. 19, 2019, entitled "Continuous Sampling Drill Bit," which is incorporated herein by reference in its entirety.

BACKGROUND

Conventionally, core sampling requires a wireline assembly for retrieving a cylindrical core sample drilled by a core sampling bit. Such core sampling is a time consuming and intensive process that requires complex wireline tooling. Accordingly, a need exists for a sampling method that eliminates wireline tooling and does not require a need to stop drilling to separate samples from the formation or to retrieve samples. Continuous sampling methods that use percussive pneumatic hammers are limited to non-water-bearing (dry) formations, require air circulation, have high energy consumption, and suffer from further limitations of percussive drill bits.

SUMMARY

Described herein, in various aspects, is a drill bit having a central axis. The drill bit can comprise a first body comprising a shank defining an inner bore and a crown having a cutting face. The crown of the first body can define an outer operative circumference and an inner operative circumference. A second body can be coupled to the first body and can comprise a shank and a crown having a cutting face. The crown of the second body can define an outer operative circumference and can be received within the inner operative circumference of the first body. The crown of the second body can have an outer diameter. The inner operative circumference of the crown of the first body and the outer operative circumference of the crown of the second body can cooperate to define a first volume. The first volume can be configured to receive a tubular core sample. The shank of the second body can define a first frustoconical surface. The first frustoconical surface can increase in diameter along the central axis in a direction away from the cutting face of the first body. The first frustoconical surface can have, along the central axis, a diameter that is sufficiently greater than the outer diameter of the crown of the second body in order to break the tubular core sample into core pieces as the core sample advances against the frustoconical surface. The first body and the second body can cooperate to define a second volume that is in communication with the first volume. The first frustoconical surface of the shank of the second body can define at least part of the second volume. The first body can define at least one conduit between the second volume and the inner bore of the shank of the first body. The at least one conduit can be adapted to enable travel of the core pieces from the second volume to the inner bore of the shank of the first body.

The first body can threadedly couple to the second body.

The first body and the second body can be unitarily formed.

The second body can comprise a base portion and an interior bore.

The base portion can define an apex that is radially spaced from the central axis.

The second body can be configured to form a core sample (optionally, a cylindrical core sample). The second body can define a core receiving space that is configured to receive the core sample. The base portion can be configured to break apart portions of the core sample formed by the second body.

In a cross sectional plane containing the central axis, the first frustoconical surface can define a break angle with respect to the central axis. The break angle can be between about five degrees and about twenty degrees.

The crown of the first body can comprise an outer surface. The outer surface of the crown of the first body can define at least one longitudinal channel that extends inwardly from the outer operative circumference of the first body.

The at least one longitudinal channel can have a cross section, in planes that are perpendicular to the central axis, that is sufficient to allow flow of drilling fluid to pump the core pieces in a proximal direction along a drill string.

The crown of the inner body can comprise first and second crown portions that are spaced apart relative to a first transverse axis that is perpendicular to the longitudinal axis.

The base portion can cooperate with the inner surfaces of the first and second crown portions of the crown to define a continuous slot.

The at least one conduit between the second volume and the inner bore of the shank of the first body can comprise a plurality of conduits spaced circumferentially about the central axis.

The second body can further define a second frustoconical surface that is spaced from the first frustoconical body in a proximal direction. The second frustoconical surface can have a decreasing diameter in the proximal direction. The second frustoconical surface can partially define the second volume.

The second volume can have annular cross sections in planes perpendicular to the central axis. The annular cross sections can have respective inner and outer diameters. Respective differences between the respective inner diameters and outer diameters can be uniform along the central axis.

The first volume can have uniform annular cross sections in planes perpendicular to the central axis.

A method can comprise: using a drill bit attached to a drill string, drilling an annular core sample. The drill bit can comprise a first body comprising a shank defining an inner bore and a crown having a cutting face. The crown of the first body can define an outer operative circumference and an inner operative circumference. A second body can be coupled to the first body and can comprise a shank and a crown having a cutting face. The crown of the second body can define an outer operative circumference and can be received within the inner operative circumference of the first body. The crown of the second body can have an outer diameter. The inner operative circumference of the crown of the first body and the outer operative circumference of the crown of the second body can cooperate to define a first volume. The first volume can be configured to receive a tubular core sample. The shank of the second body can define a first frustoconical surface. The first frustoconical surface can increase in diameter along the central axis in a direction away from the cutting face of the first body. The first frustoconical surface can have, along the central axis, a diameter that is sufficiently greater than the outer diameter of the crown of the second body in order to break the tubular core sample into core pieces as the core sample advances against the frustoconical surface. The first body and the second body can cooperate to define a second volume that is in communication with the first volume. The first frustoconical surface of the shank of the second body can define at least part of the second volume. The first body can define at least one conduit between the second volume and the inner bore of the shank of the first body. The at least one conduit can be adapted to enable travel of the core pieces from the second volume to the inner bore of the shank of the first body. The method can further comprise advancing the drill but until the first frustoconical surface breaks the core sample into core sample pieces.

The method can further comprise providing a drilling fluid to pump the core sample pieces through the at least one conduit and through the drill string.

Providing the drilling fluid can comprise pumping drilling fluid around an outer surface of the crown portion of the first body.

A drill bit can comprise a crown having a cutting face. The cutting face can comprise at least one inner crown portion defining an outer operative circumference, wherein the outer operative circumference of the inner crown portion has a diameter. The cutting face can further comprise at least one outer crown portion defining an outer operative circumference and an inner operative circumference that is spaced radially outward from the outer operative circumference of the at least one inner crown portion. The outer operative circumference of the at least one inner crown portion and the inner operative circumference of the at least one outer crown portion can define a first volume therebetween. The first volume can be configured to receive a tubular core sample. A shank can have a proximal end that is configured to couple to a drill rod. The shank can define a second volume in communication with the first volume. The second volume can comprise a frustoconical inner surface that increases in diameter along the central axis in a direction away from the cutting face. The frustoconical inner surface can have, along its length, a diameter that is sufficiently greater than the diameter of the outer operative circumference of the inner crown portion in order to break the tubular core sample into core pieces. The shank can define at least one conduit in communication with the second volume. The at least one conduit can be adapted to enable travel of the pieces from the second volume to the proximal end of the shank.

The drill bit can comprise an inner portion and an outer portion. The inner portion can comprise the at least one inner crown portion. The outer portion can comprise the at least one outer crown portion and the shank. The inner portion can threadedly couple to the outer portion. The inner portion can define the frustoconical inner surface of the second volume.

The inner portion can comprise a base portion and an interior bore. The inner operative circumference of the at least one inner crown portion can define a third volume (optionally, a cylindrical volume) that is configured to receive a core sample (optionally, a cylindrical core sample).

The base portion can define an apex that is radially spaced from the central axis.

The base portion can be configured to break off distal portions of the core sample.

In a cross sectional plane along the central axis, the frustoconical inner surface of the second volume can define a break angle with respect to the central axis, wherein the break angle is between about five degrees and about twenty degrees.

The operative circumference of the at least one crown portion can be greater than the diameter of the shank and can define at least one longitudinal channel that extends inwardly from the operative circumference.

The at least one longitudinal channel can have a cross section in planes that are perpendicular to the central axis that is sufficient to allow flow of drilling fluid that can pump the core pieces up a drill string.

The at least one inner crown portion can comprise first and second crown portions spaced apart relative to a first transverse axis that is perpendicular to the longitudinal axis.

The base portion can cooperate with the inner surfaces of the first and second crown portions of the crown to define a continuous slot.

The at least one conduit in communication with the second volume that is adapted to enable travel of the pieces from the second volume to the proximal end of the shank can comprise a plurality of conduits spaced circumferentially about the central axis.

The cutting face can comprise at least one cutting face defined by the at least one inner crown portion and at least one cutting face defined by the at least one outer crown portion.

Additional advantages of the invention will be set forth in part in the description that follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DESCRIPTION OF THE DRAWINGS

These and other features of the preferred embodiments of the invention will become more apparent in the detailed description in which reference is made to the appended drawings wherein.

DETAILED DESCRIPTION

Figure 1:
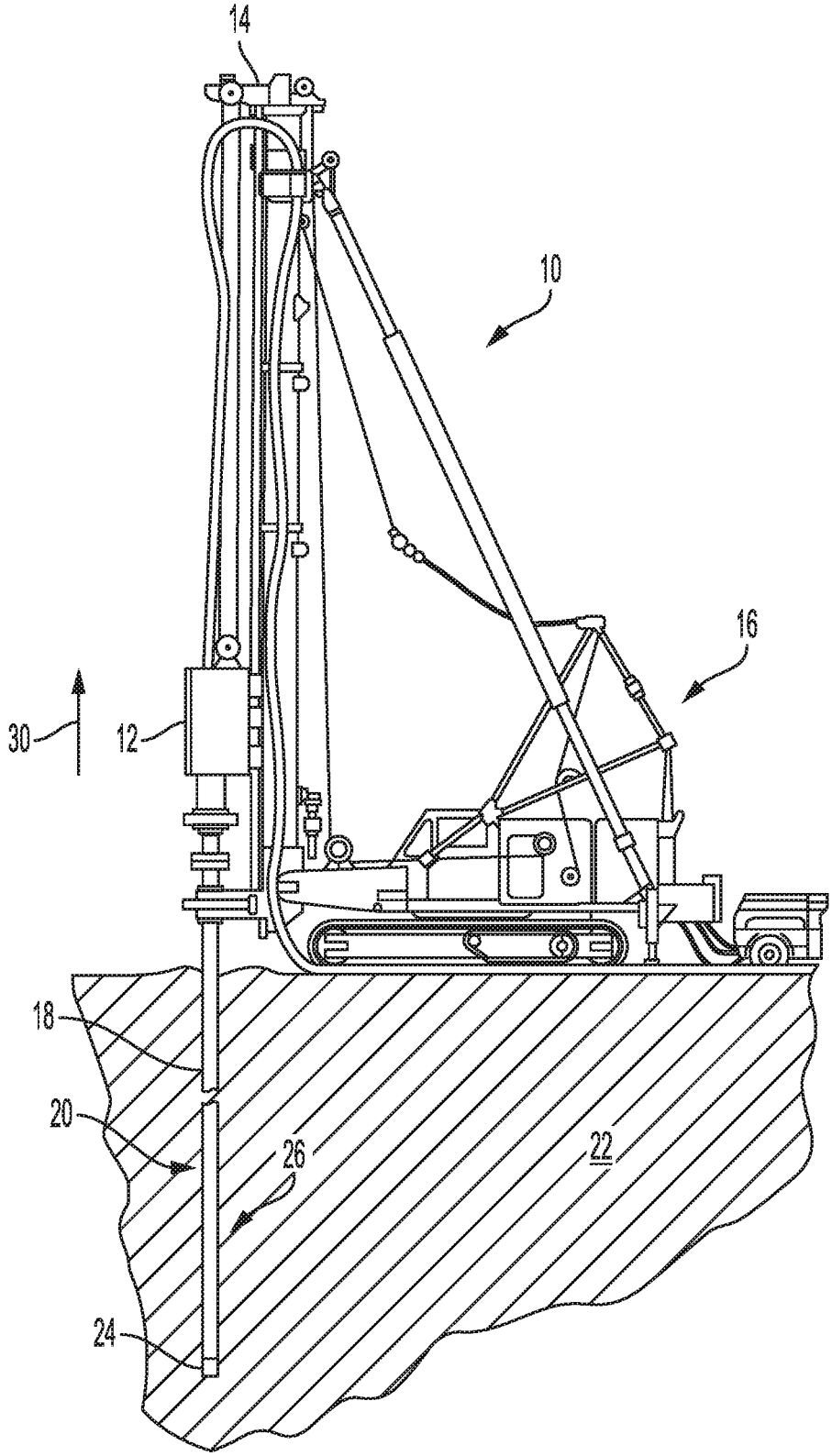
FIG. 1 is side view of a drilling system in accordance with embodiments disclosed herein.

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout. It is to be understood that this invention is not limited to the particular methodology and protocols described, as such may vary. It is also to be understood that the terminology used herein is for the purpose of describing particular embodiments only, and is not intended to limit the scope of the present invention.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

As used herein the singular forms "a," "an," and "the" include plural referents unless the context clearly dictates otherwise. For example, use of the term "a crown portion" can refer to one or more of such crown portions, and so forth.

All technical and scientific terms used herein have the same meaning as commonly understood to one of ordinary skill in the art to which this invention belongs unless clearly indicated otherwise.

As used herein, the terms "optional" or "optionally" mean that the subsequently described event or circumstance may or may not occur, and that the description includes instances where said event or circumstance occurs and instances where it does not.

As used herein, the term "at least one of" is intended to be synonymous with "one or more of" For example, "at least one of A, B and C" explicitly includes only A, only B, only C, and combinations of each.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. Optionally, in some aspects, when values are approximated by use of the antecedent "about," it is contemplated that values within up to 15%, up to 10%, up to 5%, or up to 1% (above or below) of the particularly stated value can be included within the scope of those aspects. Similarly, if further aspects, when values are approximated by use of "approximately," "substantially," and "generally," it is contemplated that values within up to 15%, up to 10%, up to 5%, or up to 1% (above or below) of the particularly stated value can be included within the scope of those aspects The word "or" as used herein means any one member of a particular list and also includes any combination of members of that list.

It is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

The following description supplies specific details in order to provide a thorough understanding. Nevertheless, the skilled artisan would understand that the apparatus, system, and associated methods of using the apparatus can be implemented and used without employing these specific details. Indeed, the apparatus, system, and associated methods can be placed into practice by modifying the illustrated apparatus, system, and associated methods and can be used in conjunction with any other apparatus and techniques conventionally used in the industry.

Disclosed herein, with reference to FIG. 1, is a drill bit for use with a drilling system 10 that includes a drill head 12. The drill head 12 can be coupled to a mast 14 that, in turn, is coupled to a drill rig 16. The drill head 12 can be configured to have one or more tubular threaded members 18 coupled thereto. Tubular members 18 can include, without limitation, drill rods, casings, and down-the-hole hammers. Optionally, in some aspects, use of embodiments disclosed herein can eliminate a need for down-the-hole hammers. For ease of reference, the tubular members 18 will be described herein after as drill string components. The drill string component 18 can in turn be coupled to additional drill string components 18 to form a drill or tool string 20. In turn, the drill string 20 can be coupled at a distal end to a drilling tool 24, such as a rotary drill bit, impregnated, core sampling drill bit, or percussive bit, configured to interface with the material, or formation 22, to be drilled. The drilling tool 24 can form a borehole 26 in the formation 22. According to some implementations of the present invention, the drilling tool 100 can include a reverse circulation continuous sampling drill bit 100, such as that depicted and described in relation to FIGS. 2-9.

In reverse circulation systems, a pressurized fluid is pumped down the borehole 26. The fluid can be pumped down an outer annulus, such as, for example, a space between the borehole 26 and the outer wall of the drill string 20. The fluid can then return through an interior of the drill string 20. In reverse circulation drilling, the returning fluid can provide fluid pressure to move certain components or materials up the drill string. As disclosed herein, the returning fluid can carry core sample bits up the drill string and to the borehole outlet. Further aspects of reverse circulation systems are disclosed in International Application No. WO 2018/152089 to BLY IP INC., filed Feb. 13, 2018, which is hereby incorporated herein in its entirety. The reverse circulation system can exclude air circulation, which can be beneficial in water-bearing formations in which air cannot be circulated. Because fluid can be passed around the outer wall of the drill string 20, dual-tube drill strings may not be required. However, according to further aspects, it is contemplated that dual-tube drill strings can be used for ground conditions that are not suitable for acting as an outer wall of a conduit through which fluid can be pumped (e.g., porous or soft ground conditions).

Figure 2:
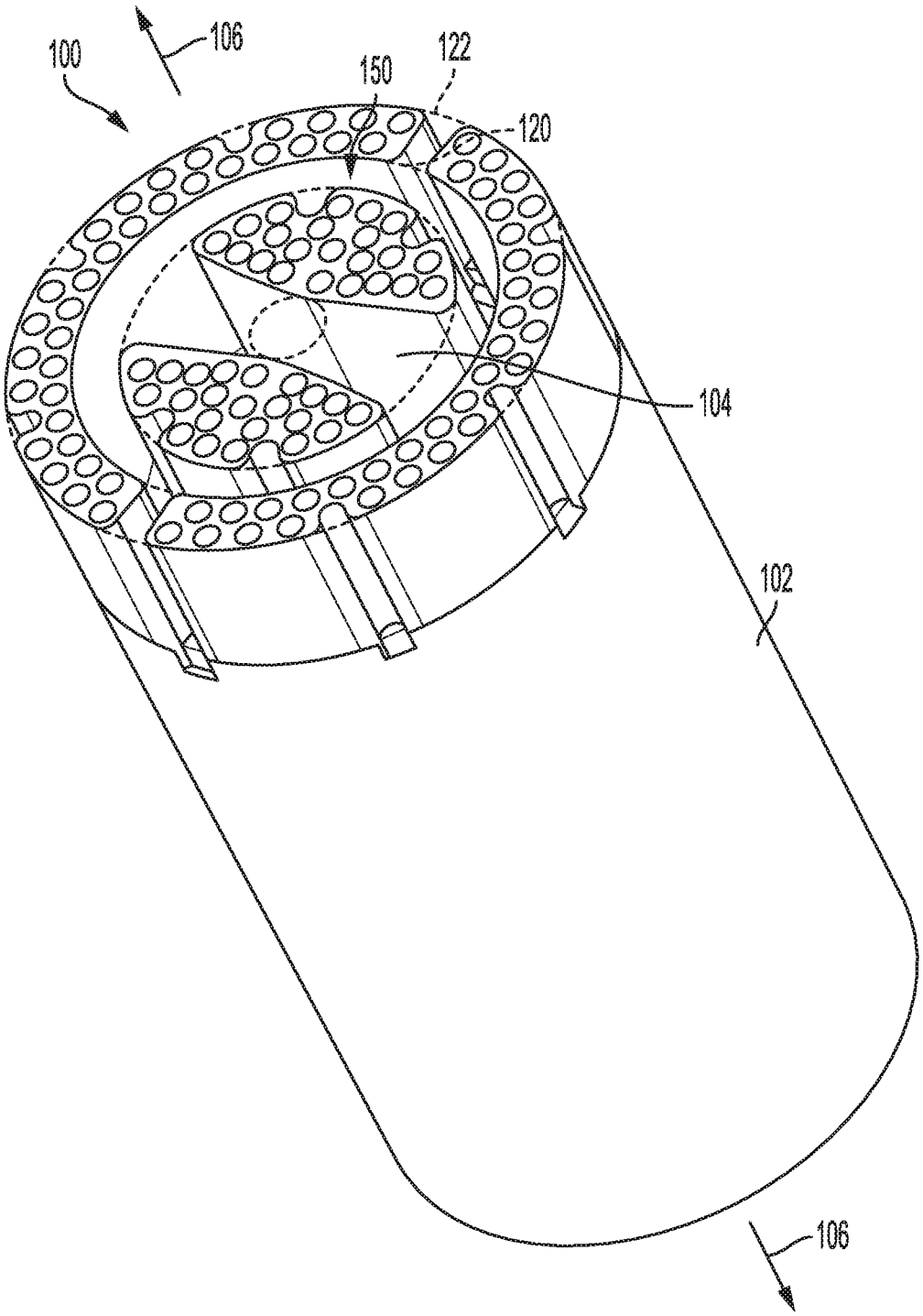
FIG. 2 is an isometric view of a drill bit for use with the drilling system of FIG. 1, in accordance with embodiments disclosed herein.
Figure 3:
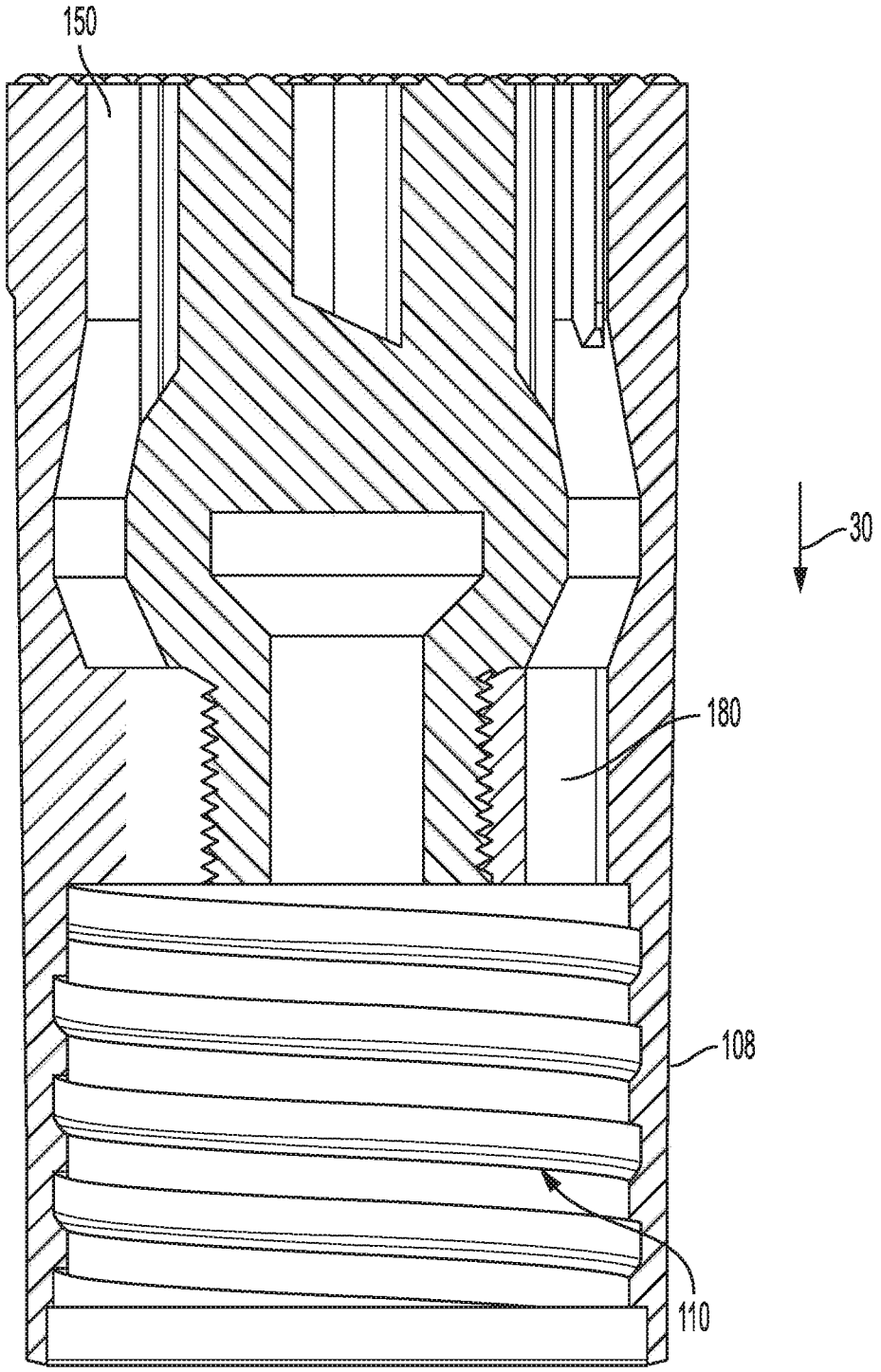
FIG. 3 is a cross sectional view of the drill bit of FIG. 2.

In various aspects and with reference to FIGS. 2-3, the drill bit 100 can comprise a first body 102 and a second body 104. The drill bit 100 can have a central axis 106. The first body 102 can comprise a shank 108 that defines an inner bore 110. The inner bore 110 of the shank 108 can define one or more female threads 112 for coupling to a distal end of a drill rod 18 (FIG. 1).

Figure 4:
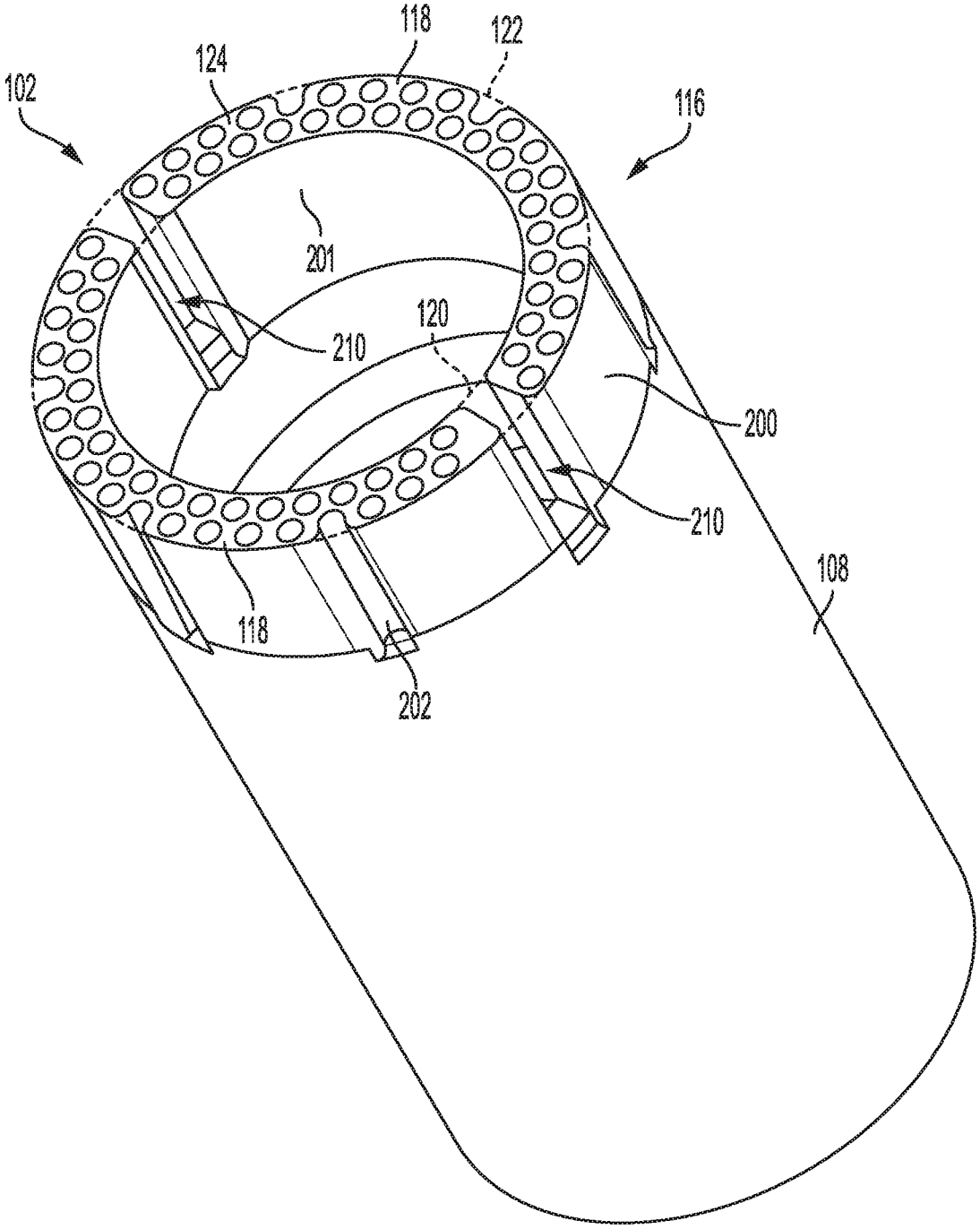
FIG. 4 is an isometric view of a first body of the drill bit of FIG. 2.
Figure 5:
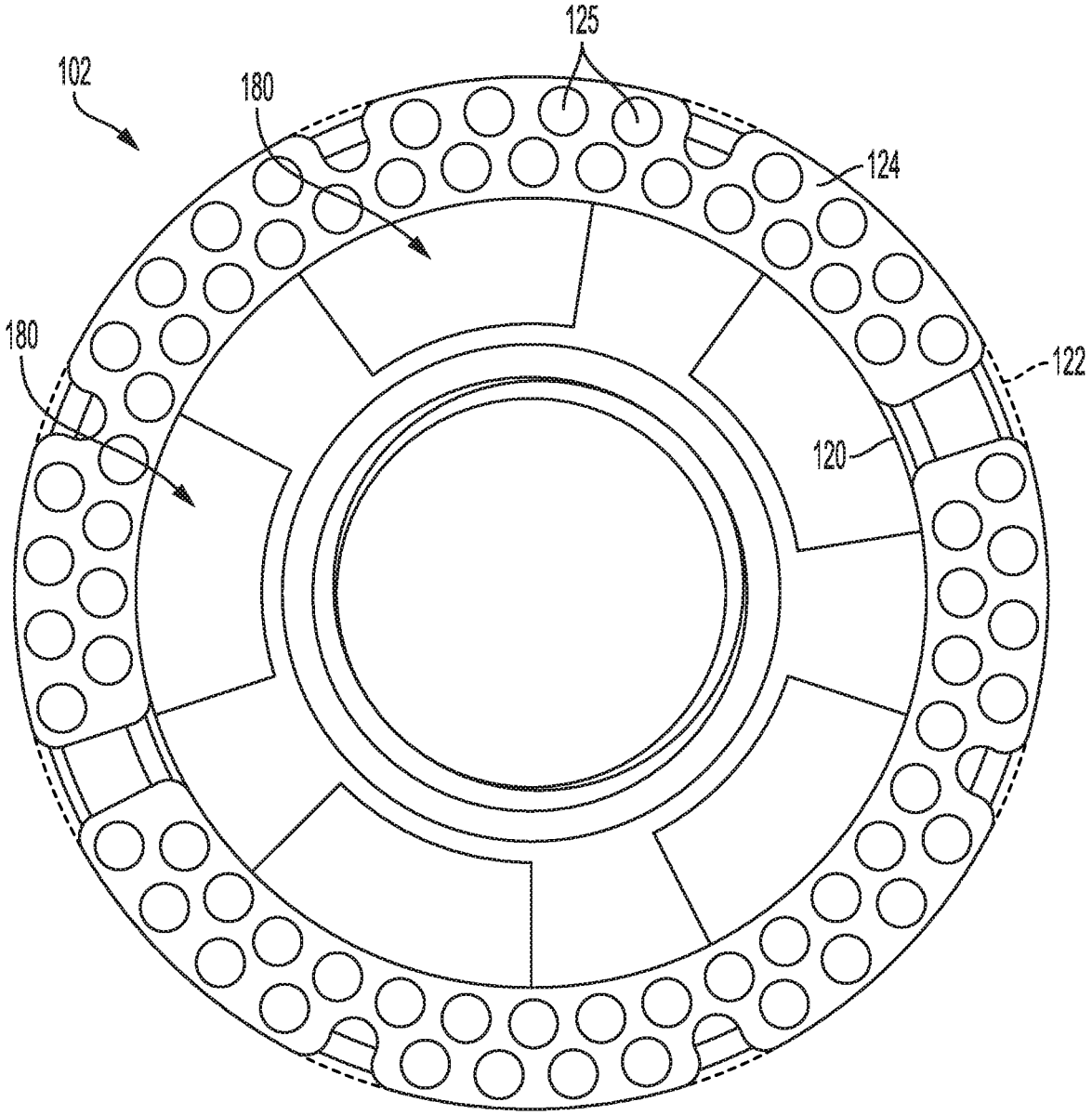
FIG. 5 is a distal end view of the first body of FIG. 4.
Figure 6:
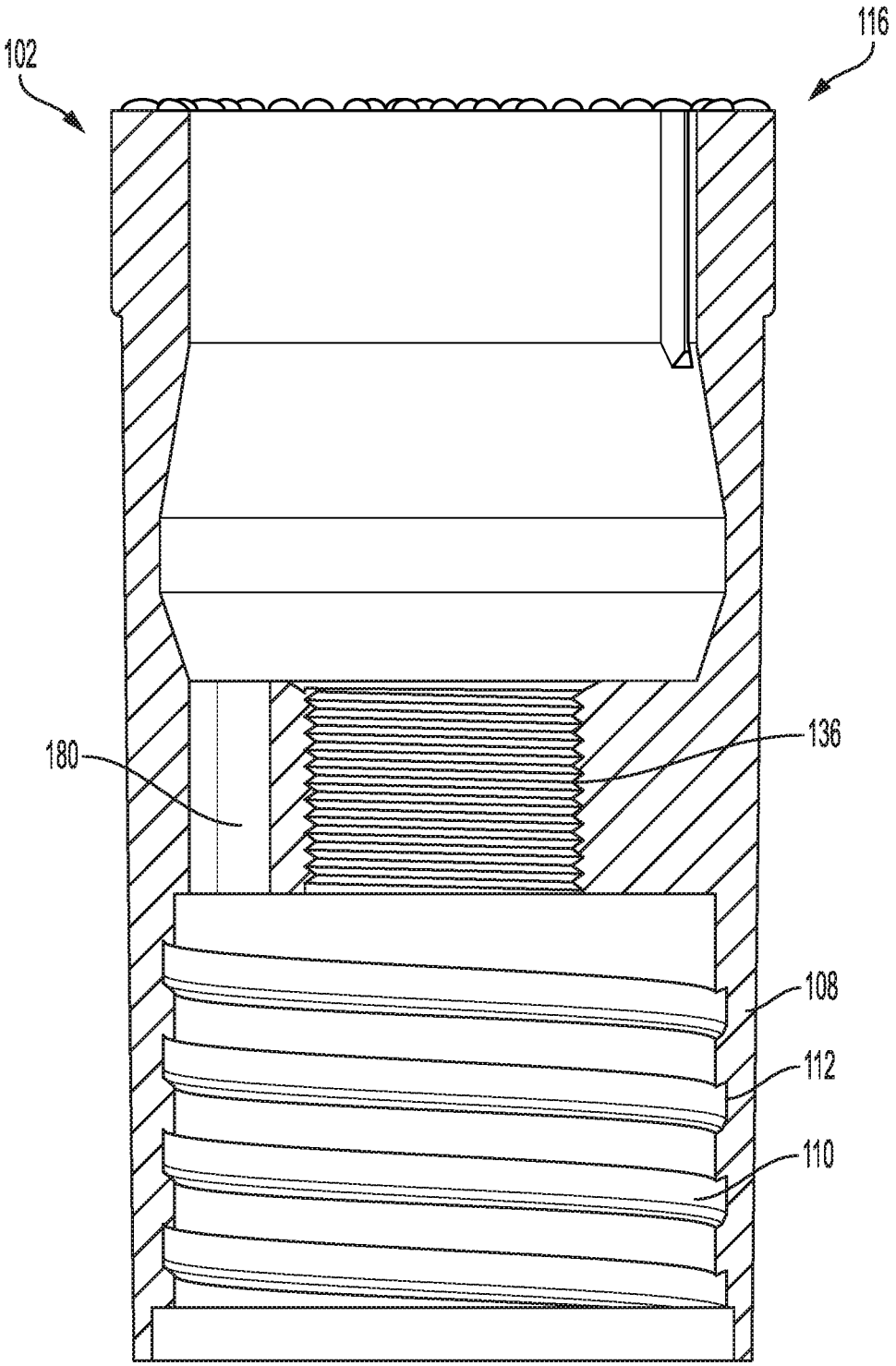
FIG. 6 is a cross sectional view of the first body of FIG. 4.

Referring to FIGS. 4-6, the first body 102 can further comprise a crown 116 having a cutting face 124 and comprising a pair of (or, optionally, one, three or more) crown portions 118. The crown 116 can comprise at least one outer surface 200 and at least one inner surface 201. The cutting face 124 can have projections 125 projecting therefrom. The crown 116 can define an inner operative circumference 120 and an outer operative circumference 122. An operative circumference can be defined as a continuous pathway (e.g., a circular or round pathway), formed within a plane that is perpendicular to the central axis 106, by tracing and connecting respective portions of the inner surface 201 or outer surface 200. Thus, the operative circumference simulates a boundary or perimeter that would exist if the inner or outer surface of the crown extended continuously (without interruption) over 360 degrees.

Figure 7:
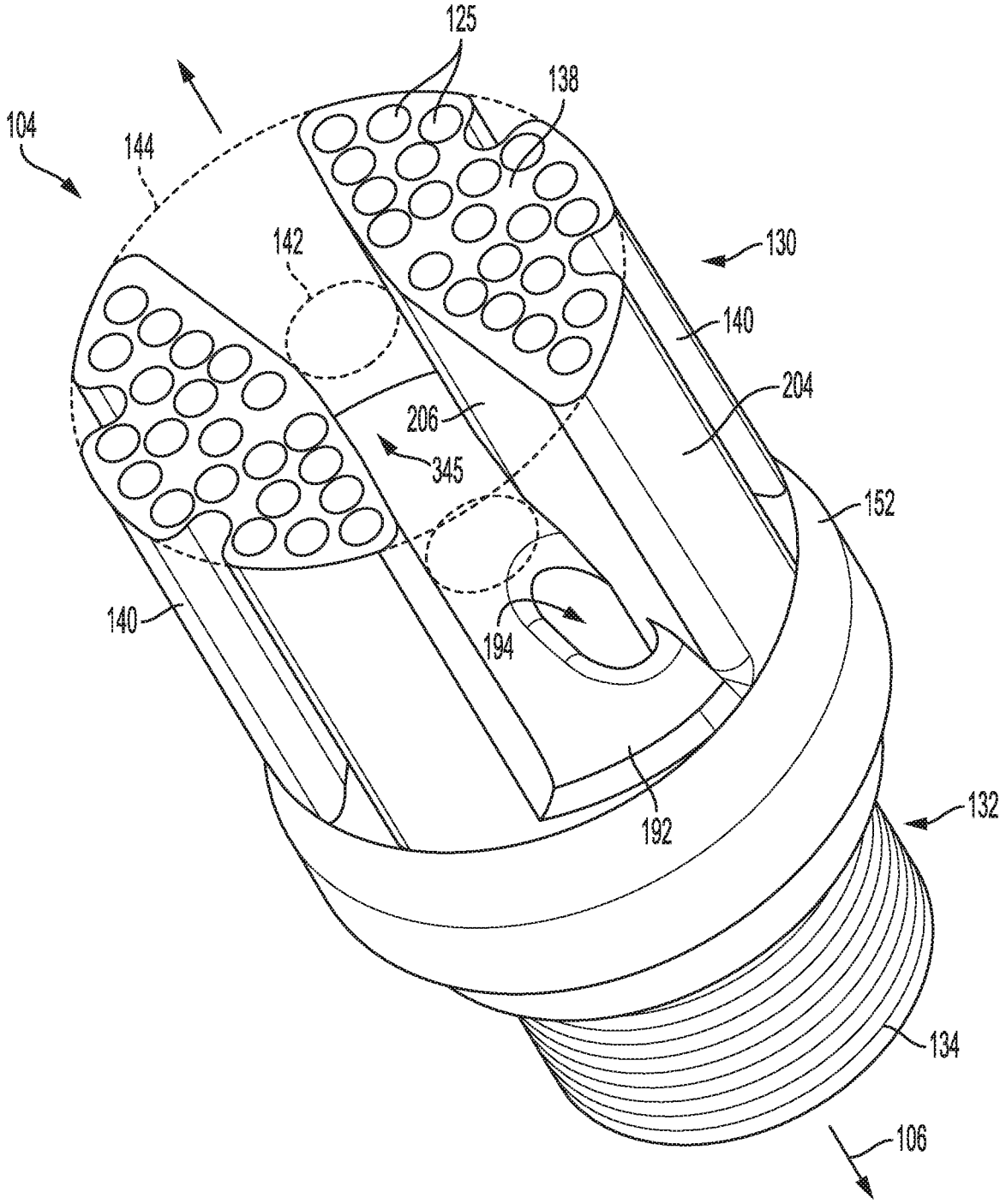
FIG. 7 is an isometric view of a second body of the drill bit of FIG. 2.
Figure 8:
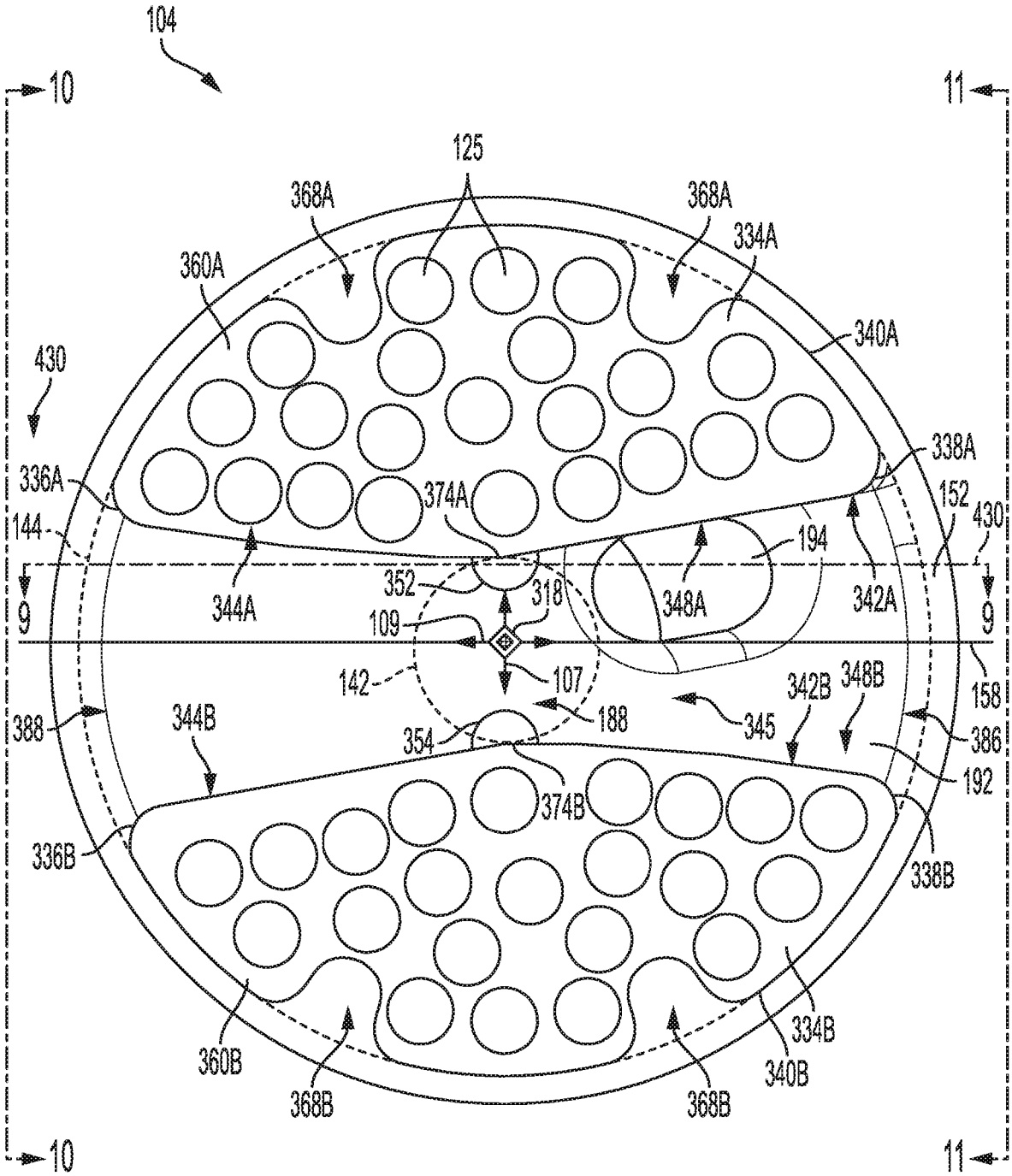
FIG. 8 is a distal end view of the second body of FIG. 7.
Figure 9:
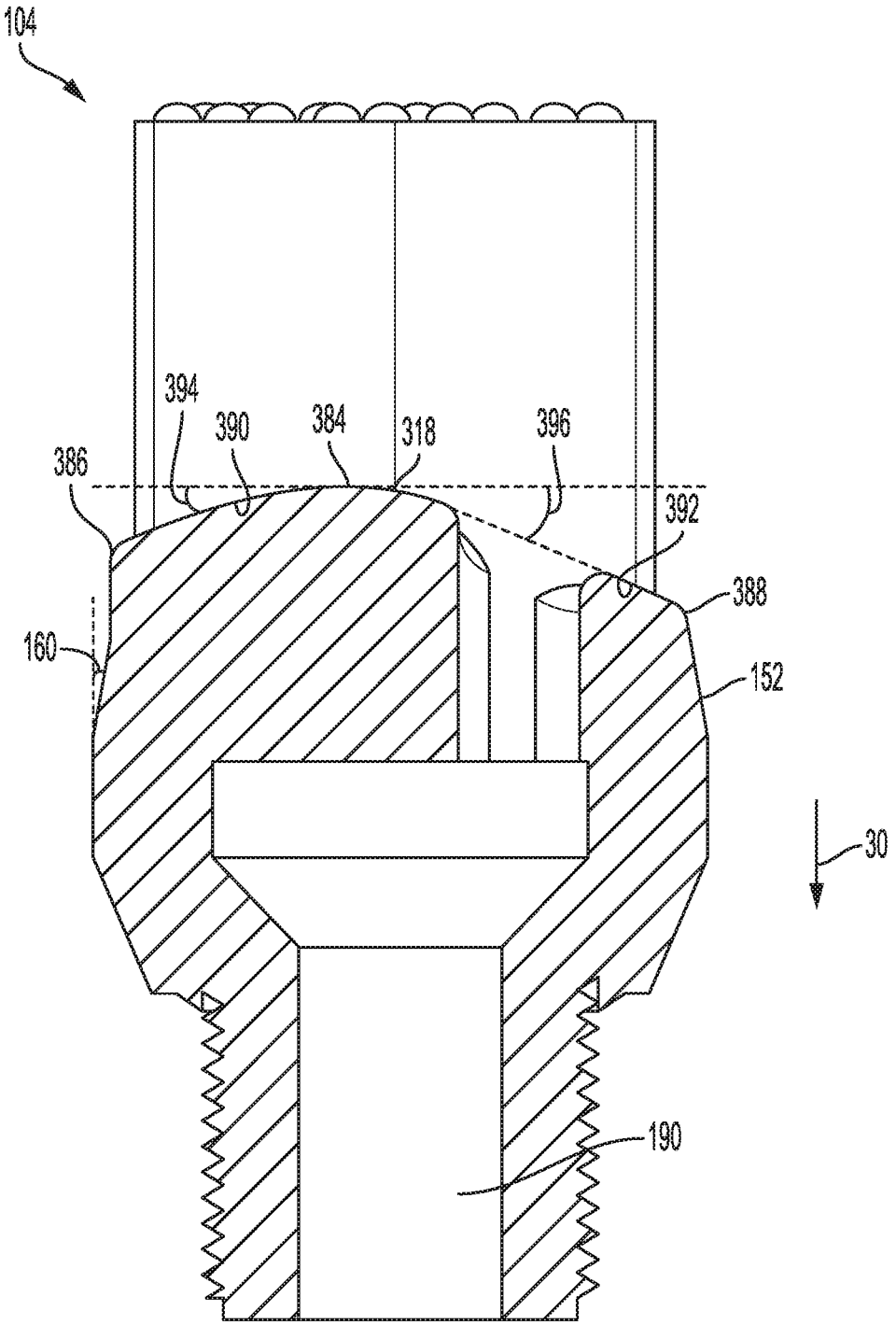
FIG. 9 is a cross sectional view of the second body of FIG. 7, taken along line 9-9 in FIG. 8.

Referring to FIGS. 7-9, the second body 104 can comprise a crown 130 and a shank 132. The crown 130 can comprise at least one outer surface 204 and at least one inner surface 206. The crown 130 of the second body 104 can define a cutting face 138 and comprise one or more crown portions 140, each having respective inner and outer surfaces. The cutting face 138 can similarly have cutting elements 125 projecting therefrom. According to some aspects, the crown 130 can comprise a plurality of crown portions, such as, for example, two crown portions 140. The crown 130 can define an outer operative circumference 144. The crown 130 can further define at least one slot 345 between the crown portions 140. The slot 345 can define a core receiving space 142. The core receiving space 142 can be defined by innermost surfaces of the crown portions 140 with respect to the central axis 106. In some embodiments, the innermost surfaces of the crown portions can be longitudinal medial edges 374A, 374B, as further disclosed herein. As the drill bit 100 rotates, the innermost surfaces can circumscribe, and thereby define, the core receiving space 142. In some aspects, the core receiving space 142 can be cylindrical. Thus, in use, the core received within the slot 345 can form a cylindrical core sample portion.

The crowns 116, 130 of the first and second bodies 102, 104 can be impregnated with diamonds so that they can be used to cut hard formations and/or to increase the durability of the bit. The part of the bit that performs the cutting action, sometimes referred to as a face, can be generally formed of a matrix that contains a powdered metal or a hard particulate material, such as tungsten carbide. This material can be infiltrated with a binder, such as a copper alloy. The matrix and binder associated with the face can be mixed (impregnated) with diamond crystals (synthetic or natural) or another form of abrasive cutting media using conventional methods. As the drill bit grinds and cuts through the formation, the matrix and binder can erode and expose new layers of the diamond crystal (or other cutting media) so that sufficient cutting action is maintained during use of the drill bits disclosed herein.

Optionally, the projections 125 can be integrally formed with their respective crowns 116, 130. Accordingly, the projections 125 can comprise the same matrix as their associated crowns 116, 130. In further embodiments, the projections 125 can comprise matrixes that are different from their respective crowns. U.S. Pat. No. 9,637,980, issued to Longyear™ Inc. on Aug. 15, 2017, which is hereby incorporated herein by reference in its entirety, discloses further aspects of diamond impregnated bits and associated projections that can optionally be implemented with the drill bit 100.

Referring to FIGS. 3, 6, and 7, the shank 132 of the second body 104 can define male threads 134, and the shank 108 of the first body 102 can define complementary female threads 136. In this way, the second body 104 can be received within, and threadedly attach to, the first body 102, within the inner operative circumference 120 of the first body's crown 116. In further embodiments, the first body 102 and the second body 104 can be a unitary (i.e., monolithic) construction that is formed as a single piece.

Figure 12:
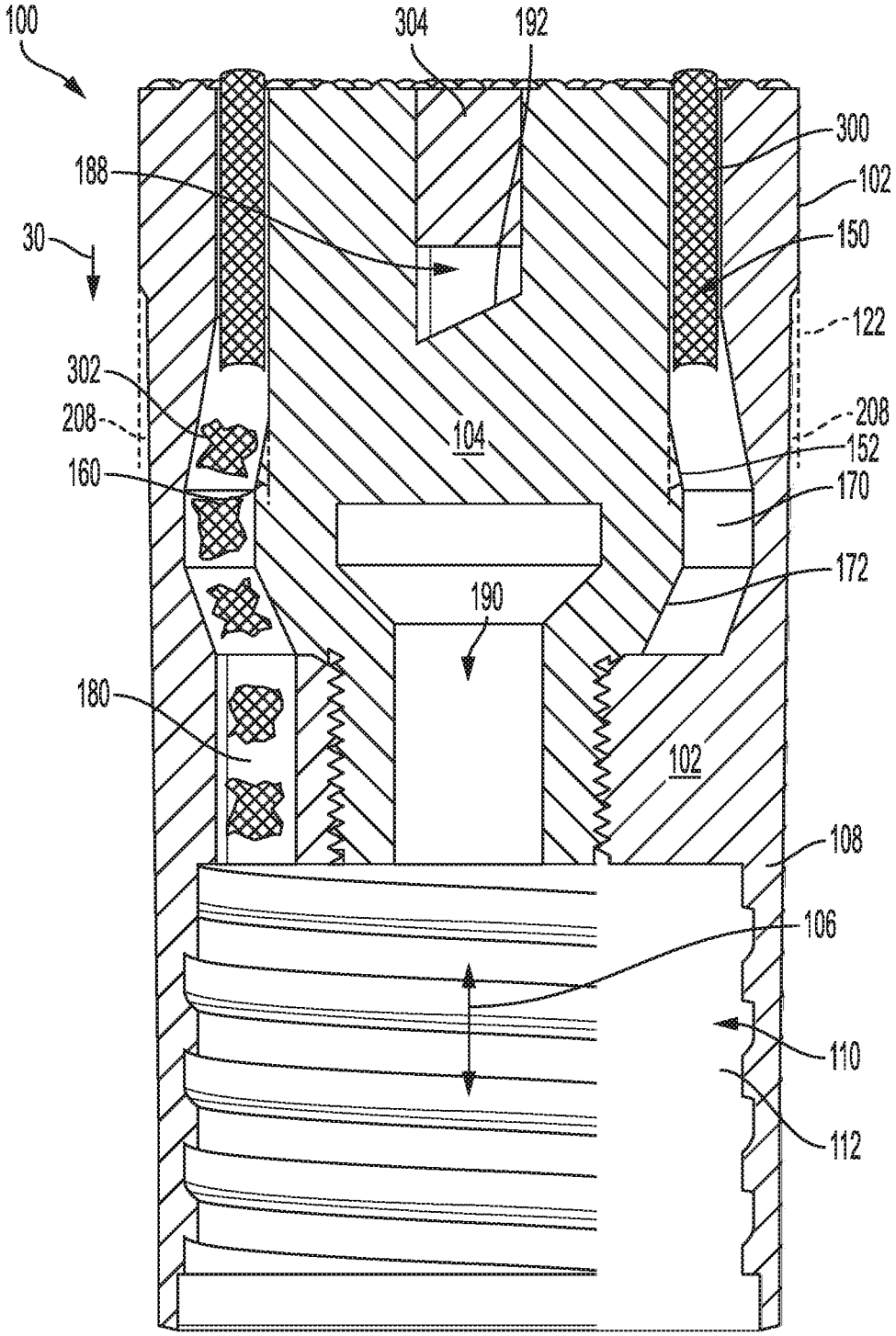
FIG. 12 is a cross sectional view of the drill bit of FIG. 2 showing movement of formation material and drilling fluid when in use.

Referring to FIGS. 2, 3, and 12, the inner operative circumference 120 of the first body's crown 116 and the outer operative circumference 144 of the second body's crown 130 can cooperate to define a first volume 150 that is configured to receive a tubular core sample 300. The first volume 150 can have uniform annular cross sections in planes perpendicular to the central axis 106. In further aspects, the first volume 150 can be defined as the volume between the inner surface 201 (FIG. 4) of the first body's crown 116 and the outer surface 204 (FIG. 7) of the second body's crown 130.

The shank 132 of the second body 104 can define a first frustoconical surface 152. The frustoconical surface 152 can correspond to a conical frustum having an axis that is aligned with the central axis 106. The minor diameter of the first frustoconical surface 152 can have the same diameter as the outer operative circumference 144 of the second body's crown 130. The first frustoconical surface 152 can have an increasing diameter in a proximal direction 30 (i.e., toward the drill rig) to a major diameter. The major diameter of the first frustoconical surface 152 can be selected so that at least the major diameter, if not a diameter of a cross section between the major diameter and the minor diameter, is sufficient to break the tubular core sample into core pieces 302 as the core sample 300 advances proximally, relative to the drill bit, and biases against the first frustoconical surface 152. The first frustoconical surface 152, in a plane 158 that longitudinally bisects the drill bit and includes the central axis 106, defines a break angle 160 with respect to the central axis 106. Optionally, the break angle 160 can be between about five degrees and about twenty degrees, and, in some exemplary aspects, be about ten degrees.

The first body 102 and the second body 104 can cooperate to define a second volume 170 that is in communication with the first volume 150. Accordingly, the second volume 170 can be configured to receive the tubular core sample 300 from the first volume 150. The first frustoconical surface 152 can define a portion of the second volume 170. The second volume 170 can have annular cross sections in planes perpendicular to the central axis 106. The annular cross sections can have a consistent radial thickness. The second body 104 can define a second frustoconical surface 172 that is proximal of the first frustoconical surface 152 and decreases in diameter in the proximal direction 30. Accordingly, the annular cross sections of the second volume 170 can have maximum diameters at a central position along the longitudinal length of the second volume 170.

The first body 102 can define at least one conduit 180 or, optionally, a plurality of conduits 180, (e.g., optionally, three, four, or five, as shown) that extends between the second volume 170 and the inner bore 110 of the first body 102. The conduits 180 can allow the core pieces 302 to travel from the second volume 170 to the inner bore 110 of the first body 102 and (proximally) up the drill string 20 (FIG. 1). The conduits 180 can be circumferentially spaced (optionally, equally circumferentially spaced) about the central axis 106. As shown in FIG. 5, the conduits 180 can have cross sections (in planes perpendicular to the central axis 106) that are annular sectors having annular thicknesses. It is contemplated that the drill bit 100 can be designed so that core pieces 302 can have a major dimension that is no larger than three sixteenths of an inch. For such a drill bit, the annular thickness can be, for example, about one quarter of an inch. It is contemplated that the conduits 180 can have a minor dimension that is expected to be greater than a major dimension of all core pieces 302. For example, the minor dimension of the conduits 180 can be greater than or equal to 3/16 of an inch. In some embodiments, the annular thickness can increase in the proximal direction 30.

The core receiving space 142 of the second body's crown 130 can define a third inner volume 188 that can receive a core sample 304 (optionally, a cylindrical core sample). The crown 130 of the second body 104 can define an interior bore 190. The second body's crown 130 can have a base surface 192. The base surface 192 can have a sloped surface (i.e., not coplanar with a plane that is perpendicular to the central axis) having an apex (i.e., a distal-most point) that is off-center with respect to the central axis 106. Thus, as the cylindrical core sample 304 engages the sloped base surface 192, the cylindrical core sample can undergo a lateral force that causes the cylindrical core sample to break off. The portion of the cylindrical core sample 304 that has broken off can be centrifugally ejected radially outward and into the first volume 150. The cylindrical core sample 304 can be further broken apart into smaller pieces that pass through the conduits 180.

According to some optional embodiments, the second body 104 can define a conduit 194 that extends longitudinally from the base surface 192 to the interior bore 190. The conduit 194 can extend parallel or substantially parallel to, and can be radially offset from, the central axis 106. The conduit 194 can be configured to communicate drilling fluid, cuttings, and core sample pieces therethrough and to the interior of the drill string 20 (FIG. 1). In further embodiments, the conduit 194 can be omitted from the drill bit 100.

In the embodiment shown in the Figures, the apex of the base surface 192 is disposed distal of the distal edge of the first frustoconical surface 152. Thus, when the drill bit 100 is in use, the cylindrical core sample 304 can engage the base surface 192 (and, thus, break off) before the portion of the tubular core sample 300 from the same depth in the formation engages the first frustoconical surface 152 and breaks into core sample pieces 302. In further embodiments, the apex of the base surface 192 and the distal edge of the first frustoconical surface 152 can be spaced equally from the proximal end of the drill bit 100. In still further embodiments, the distal edge of the first frustoconical surface 152 can be distal of the apex of the base surface 192.

The drill bit 100 can sample a total cross sectional area, in planes perpendicular to the central axis, that is defined as a sum of the cross sectional area of the first inner volume 150 and the cross sectional area of the third inner volume 188. In some aspects, the total cross sectional area can range from less than a Diamond Core Drilling Manufacturers Association (DCDMA) A-size core (about 5 square centimeters) to an NQ-size core (18 square centimeters) cross section.

The crown 118 of the first body 102 can comprise at least one through-slot 210 (optionally, a plurality of through-slots, such as the two through-slots 210 shown in the Figures) that extends axially from the cutting face in a proximal direction and extends radially between outer and inner surfaces 200, 201 of the crown 118. It is contemplated that the through-slots 210 can assist with flushing of cuttings and cooling and pressure control at the cutting face of the first body. The crown 118 of the first body 102 can comprise an outer surface 200 that defines at least one longitudinal channel 202, or, optionally, a plurality of longitudinal channels 202. The outer surface 200 and, thus, the outer operative circumference 144 of the first body's crown 116 can have a greater diameter than the shank of the first body 102 and the drill string 20 (FIG. 1). Thus, the formation and drill string can define an annulus 208 through which fluid can be pumped. The drilling fluid can pass through the longitudinal channels 202, which extend radially inwardly from the outer surface 200. The fluid can lubricate and cool the drill bit 100. Further, the longitudinal channels can enable sufficient fluid to pass therethrough to pump the core pieces proximally up the drill string to be retrieved at the borehole outlet (e.g., the borehole collar). The fluid flow rate and pressure can be sufficient to overcome fluid drag from the surface to the bottom of the bore and back to the surface as well as to provide sufficient fluid flow to cool the drill bit. Further, a sufficient fluid velocity can be maintained to avoid settling out of core sample pieces.

Once pumped to the surface, a conduit can deliver the mix of drilling fluid, cuttings, and core sample pieces to an apparatus (e.g., a screen) that selectively filter out the larger core sample pieces and allow the drilling fluid and cuttings to pass therethrough. Thus, the core sample pieces can be separated for analyzing the formation makeup. As the core sample pieces are separated, the pieces can be associated with a select depth at which they were removed from the borehole. The core sample pieces can be sufficiently large to enable geophysical interpretation of the drilled formation using conventional methods. In this way, the formation can be characterized.

Because, particularly for deeper boreholes, a substantial delay can exist between the time that the drill bit 100 breaks the core sample pieces and the time that the core sample pieces are pumped to the surface. During the substantial delay, the drill bit can travel to a lower depth. Thus, core sample pieces may not be associated with the (known) depth of the drill bit when the core sample pieces reach the surface. Accordingly, an operator may be able to account for the delay and approximate the actual depth from which the core sample pieces were taken.

Referring to FIGS. 1 and 12, the drill bit 100 can be used according to the following method. The drill bit 100 can be used to drill through the formation 22. A pump can deliver fluid down the borehole via the outer annulus between the borehole wall and the drill string outer wall. Optionally, the pump can be a positive displacement reciprocating piston-style fluid supply pump, as is known in the art. As the drill bit 100 forms core sample pieces, the fluid can carry the core sample pieces to the borehole outlet through the inner bore of the drill string. The core sample pieces can be separated from the fluid and cuttings. The separated core sample pieces can be marked, tagged, or otherwise associated with the depth from which they were removed.

Crown Portions of the Second Body

In exemplary aspects, and with reference to FIGS. 7-11, the second body 104 of the drill bit 100 disclosed herein can have a first crown portion 334A and a second crown portion 334B. In further exemplary aspects, it is contemplated that the crown of the second body can have a concave shape. In still further exemplary aspects, it is contemplated that the crown of the second body can have a non-concave shape.

In one aspect, the first crown portion 334A and the second crown portion 334B can be spaced apart relative to a first transverse axis 107 that is perpendicular to the central axis 106 (FIG. 1). In a further aspect, each of the first and second crown portions 334A, 334B can comprise a first longitudinal edge 336A, 336B, a second longitudinal edge 338A, 338B, an outer surface 340A, 340B, at least one inner surface 342A, 342B, and a cutting face 360A, 360B. In this aspect, the outer surface 340A, 340B can extend between the first longitudinal edge 336A, 336B and the second longitudinal edge 338A, 338B. As shown in FIGS. 7-8, the outer surface 340A, 340B can define a portion of the outer operative circumference 144 of the crown 130. In another aspect, the at least one inner surface 342A, 342B of each of the first and second crown portions 334A, 334B can extend from the first longitudinal edge 336A, 336B to the second longitudinal edge 338A, 338B of the crown portion. Optionally, in exemplary aspects, the radial distance from a center 318 of the bit to the outer surfaces 340A, 340B of the crown portions 334A, 334B can range from about 0.625 inches to about 6.25 inches.

Optionally, in exemplary aspects, the at least one inner surface 342A, 342B of the first and second crown portions 334A, 334B can comprise a plurality of inner surfaces. In one aspect, each of the first and second crown portions 334A, 334B can respectively have a first inner surface 344A, 344B, a second inner surface 348A, 348B, and a longitudinal medial edge 374A, 374B. In one aspect, the first inner surface 344A, 344B can extend from the first longitudinal edge 336A, 336B of the crown portion 334A, 334B to the longitudinal medial edge 374A, 374B of the crown portion 334A, 334B. In this aspect, the second inner surface 348A, 348B can extend from the second longitudinal edge 338A, 338B of the crown portion to the longitudinal medial edge 374A, 374B. Optionally, in exemplary aspects, the longitudinal medial edges 374A, 374B of the first and second crown portions 334A, 334B can be positioned on opposed sides of the first transverse axis 107, which passes through the center 318 of the drill bit.

In additional optional aspects, the second inner surface 348A, 348B of each of the first and second crown portions 334A, 334B is substantially flat. Alternatively, in other optional aspects, at least a portion of the second inner surface 348A, 348B of the first and second crown portions 334A, 334B can be curved. In these aspects, it is contemplated that the second inner surface 348A, 348B of at least one of or both of the first and second crown portions 334A, 334B can be angled or tapered away from a second transverse axis 109 that is perpendicular to the central axis 106 and the first transverse axis 107, moving from the longitudinal medial edge 374A, 374B to the second edge 338A, 338B of the crown portion. It is further contemplated that the curve can have any desired curvature profile, such as, for example and without limitation, a convex curve, a concave curve, a serpentine pattern, and the like.

In further exemplary aspects, the first edges 336A, 336B of the first and second crown portions 334A, 334B can be spaced apart by a first distance relative to the first transverse axis 107, and the second edges 338A, 338B of the first and second crown portions 334A, 334B can be spaced apart by a second distance relative to the first transverse axis 107. Optionally, in exemplary aspects, the first and second distances can range from about 0.125 inches to about 1 inch. Optionally, in these aspects, the second distance can be greater than the first distance. In additional optional aspects, it is contemplated that at least a portion of the first inner surface 344A, 344B of each of the first and second crown portions 334A, 334B can be substantially flat. In these aspects, the first inner surface 344A, 344B of each of the first and second crown portions 334A, 334B can be angled away from the second transverse axis 109. Optionally, in further exemplary aspects, it is contemplated that at least a portion of the first inner surface 344A, 344B of each of the first and second crown portions 334A, 334B can be curved. In these aspects, it is contemplated that the curve can have any desired curvature profile, such as, for example and without limitation, a convex curve, a concave curve, a serpentine pattern, and the like.

As one will appreciate, and with reference to FIG. 8, during normal rotation of the second body 104, the first inner surface 344A of the first crown portion 334A and the second inner surface 348B of the second crown portion 334B can serve as the leading edges of the drill bit, with the second inner surface 348A of the first crown portion and the first inner surface 344B of the second crown portion serving as the trailing edges of the drill bit. However, it is contemplated that the direction of rotation of the drill bit can be reversed, such that the second inner surface 348A of the first crown portion 334A and the first inner surface 344B of the second crown portion 334B serve as the leading edges of the drill bit, with the first inner surface 344A of the first crown portion and the second inner surface 348B of the second crown portion serving as the trailing edges of the drill bit.

In exemplary aspects, the first inner surface 344A and the second inner surface 348A of the first crown portion 334A can be angularly oriented relative to each other at a first desired angle 52. In these aspects, the first inner surface 344B and the second inner surface 348B of the second crown portion 334B can be angularly oriented relative to each other at a second desired angle 354. It is contemplated that the first desired angle 352 can be substantially equal to the second desired angle 354. Alternatively, it is contemplated that the first desired angle 352 can be different than the second desired angle 354. The first desired angle 352 can range from about 30° to about 330°, preferably range from about 135° to about 225°, and more preferably be about 200°. The second desired angle 354 can range from about 30° to about 330°, preferably range from about 135° to about 225°, and more preferably be about 200°.

In one aspect, the first inner surfaces 344A, 344B of the first and second crown portions 334A, 334B have respective lengths that correspond to the distance between the first longitudinal edge 336A, 336B and the longitudinal medial edge 374A, 374B of each crown portion. Optionally, in exemplary aspects, the length of the first inner surface 344A of the first crown portion 334A does not equal the length of the first inner surface 344B of the second crown portion 334B. However, it is contemplated that the lengths of the first inner surfaces 344A, 344B can optionally be substantially equal. In other aspects, the second inner surfaces 348A, 348B of the first and second crown portions 334A, 334B have respective lengths that correspond to the distance between the second longitudinal edge 338A, 338B and the longitudinal medial edge 374A, 374B of the crown portion 334A, 334B. Optionally, in exemplary aspects, the length of the second inner surface 348A of the first crown portion 334A does not equal the length of the second inner surface 348B of the second crown portion 334B. However, it is contemplated that the lengths of the second inner surfaces 348A, 348B can optionally be substantially equal.

In one exemplary aspect, the length of the first inner surface 344A of the first crown portion 334A does not equal the length of the second inner surface 348A of the first crown portion 334A. In another exemplary aspect, the length of the first inner surface 344B of the second crown portion 334B does not equal the length of the second inner surface 348B of the second crown portion 334B. Optionally, in a further exemplary aspect, the length of the first inner surface 344A of the first crown portion 334A does not equal the length of the second inner surface 348A of the first crown portion 334A, and the length of the first inner surface 344B of the second crown portion 334B does not equal the length of the second inner surface 348B of the second crown portion 334B.

In one aspect, the cutting faces 360A, 360B of the first and second crown portions 334A, 334B have respective heights relative to the central axis 106 of the drill bit 100. Optionally, in some exemplary aspects, the height of the cutting face 360A of the first crown portion 334A can be substantially equal to the height of the cutting face 360B of the second crown portion 334B. However, it is contemplated that the heights of the cutting faces 360A, 360B can optionally be different from one another.

In a further aspect, the outer surfaces 340A, 340B of the crown portions 334A, 334B can define a plurality of channels 368A, 368B extending radially inwardly toward the central axis 106. Optionally, it is further contemplated that the plurality of channels 368A, 368B can expose and be in communication with a junction surface of the shank. It is further contemplated that the junction surface can optionally comprise at least one bore positioned in communication with at least one of the plurality of channels 368A, 368B of each of the first and second crown portions 334A, 334B.

Optionally, in exemplary aspects, the plurality of channels 368A, 368B can be substantially equally circumferentially spaced about the outer surface 340A, 340B of the crown portions 334A, 334B. In one aspect, it is contemplated that the plurality of channels 368A, 368B can optionally be substantially equally sized.

Base Surface of the Second Body

In exemplary aspects, the crown 130 of the second body 104 disclosed herein can have a base surface 192 that is spaced from the cutting faces 360A, 360B of each of the crown portions 334A, 334B relative to the central axis 106 of the drill bit. As shown in FIGS. 7-11, the base surface 192 and the inner surfaces 342A, 342B of the first and second crown portions 334A, 334B can cooperate to define a slot 345 that extends across the drill bit, dividing the first and second crown portions.

In a further aspect, the slot 345 can extend longitudinally therein a portion of the cutting faces 360A, 360B and the circumferential outer surface 340A, 340B of the first and second crown portions 334A, 334B. It is contemplated that this slot can be configured to allow for the fracture and ejection of desired core samples.

In a further aspect, the base surface 192 and the cutting face 360A of the first crown portion 334A can be spaced apart a first axial distance relative to the central axis 106. Optionally, in one exemplary aspect, the first axial distance can vary moving across the base surface 80 relative to the first transverse axis 107. In a further exemplary aspect, the first axial distance (between the base surface 192 and the cutting face 360A of the first crown portion 334A relative to the central axis 106) can vary moving across the base surface relative to the second transverse axis 109. In yet another exemplary aspect, the first axial distance (between the base surface 192 and the cutting face 360A of the first crown portion 334A relative to the central axis 106) can vary moving across the base surface relative to both the first transverse axis 107 and the second transverse axis 109. Optionally, in exemplary aspects, the first axial distance can range from about 0.25 inches to about 8 inches, and, more preferably, from about 0.25 inches to about 6 inches.

In optional contemplated aspects, at least a portion of the base surface 192 can be substantially planar, and at least a portion of the base surface can be curved (either distally or proximally). In other contemplated aspects, the base surface 192 can have a compound curvature, with a first portion of the base surface having a first radius of curvature and at least a second portion of the base surface having a second radius of curvature different from the first radius of curvature.

In exemplary aspects, it is contemplated that the base surface 192 can further define an apex 384 that is spaced from the center 318 of the drill bit 100 relative to the central axis 106. Optionally, in these aspects, the apex 384 can be spaced from the center 318 of the drill bit 100 relative to the first transverse axis 107. Optionally, in another aspect, the apex 384 can be spaced from the center 318 of the drill bit 100 relative to the second transverse axis 109, which is perpendicular to the central axis 106 and the first transverse axis 107. In further aspects, the apex 384 can optionally be positioned proximate an inner surface 344A, 344B, 348A, 348B of one of the first and second crown portions 334A, 334B.

In an exemplary aspect, the base surface 192 can extend from a first base edge 386 to a second base edge 388 relative to the second transverse axis 109. In a further aspect, the first base edge 386 can extend between the first inner surfaces 344A, 344B of the first and second crown portions 334A, 334B and the second base edge 388 can extend from the second inner surfaces 348A, 348B of the first and second crown portions.

Figure 10:
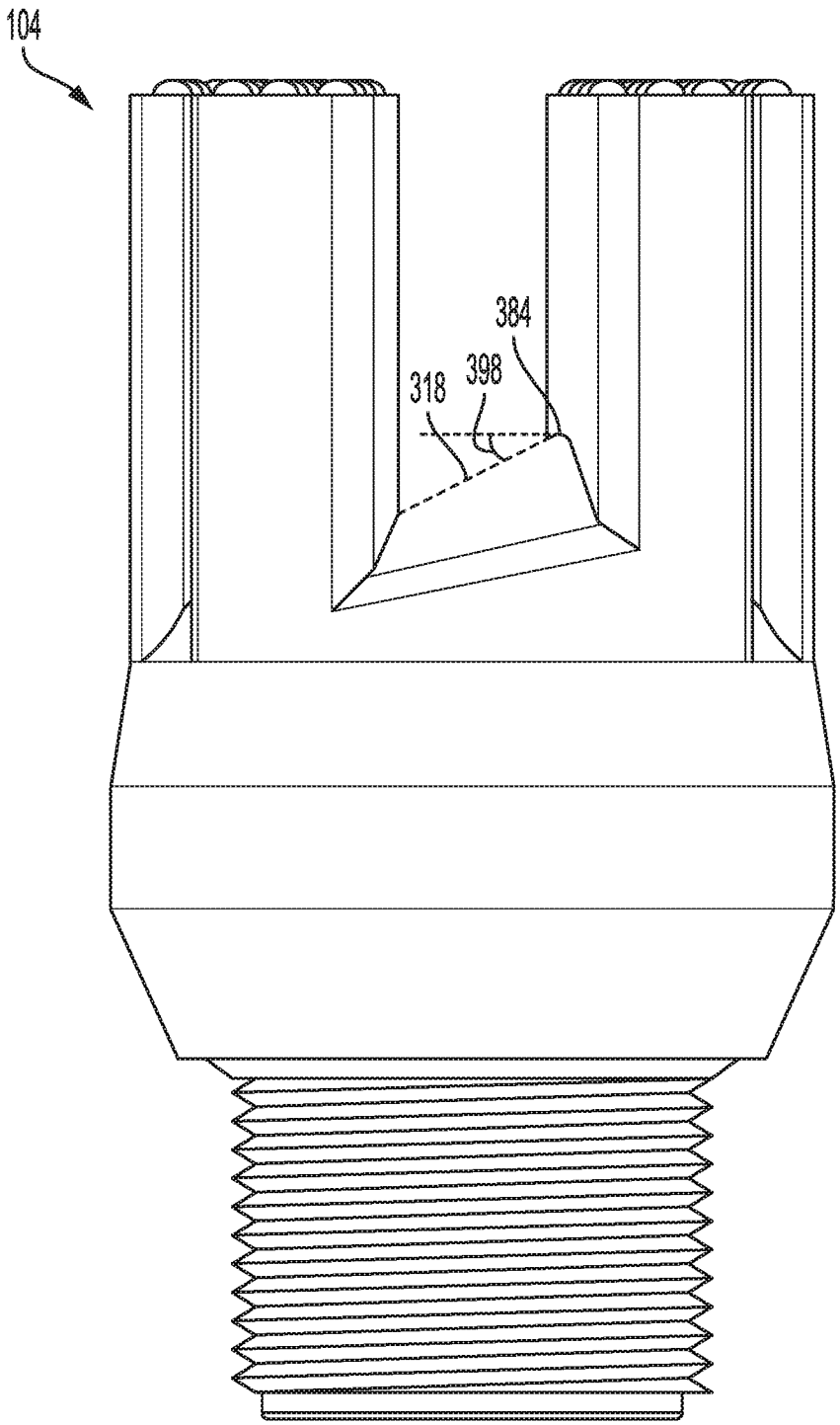
FIG. 10 is a first side view of the second body of FIG. 7.
Figure 11:
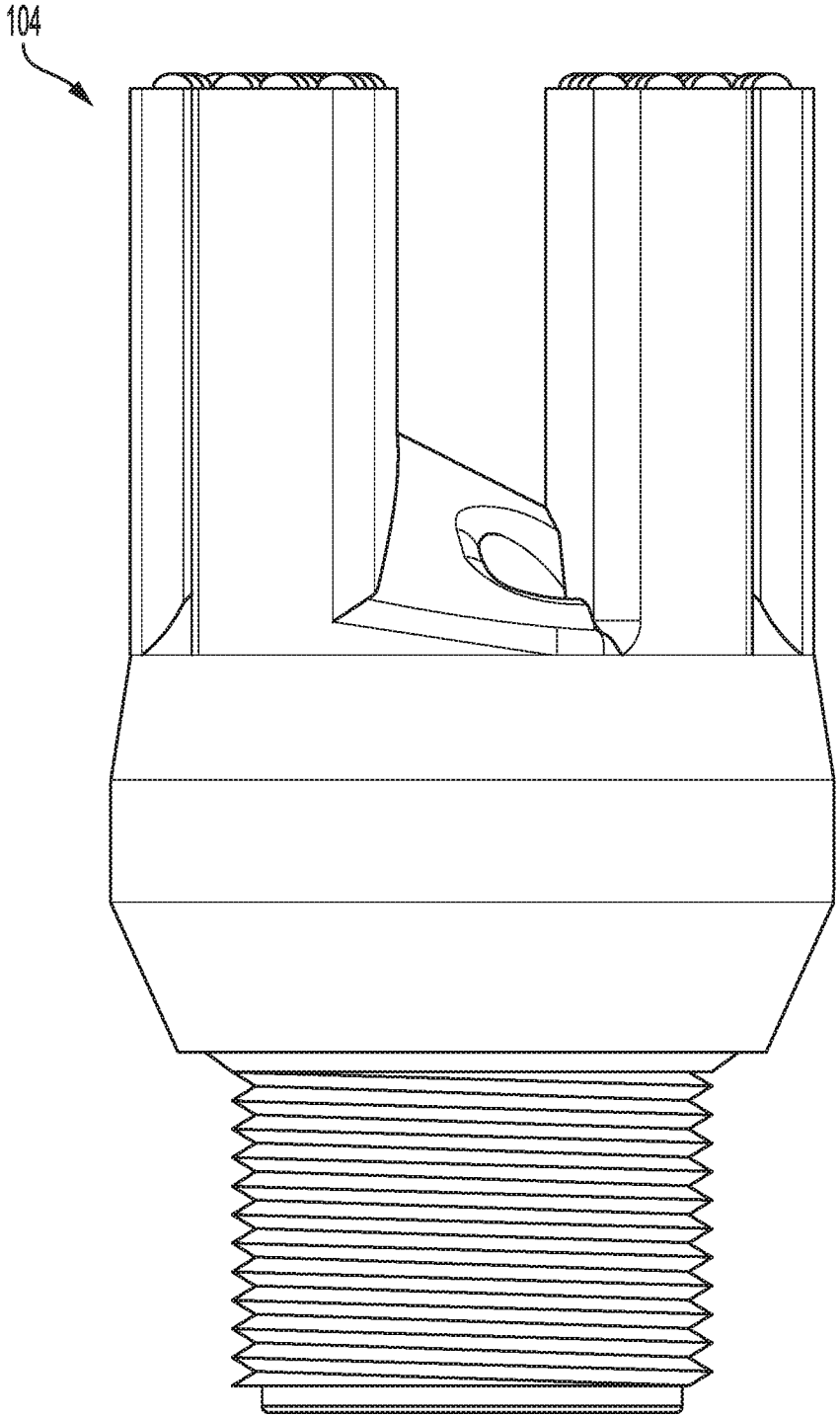
FIG. 11 is a second side view, opposite the first side view of FIG. 10, of the second body of FIG. 7.

As shown in FIG. 10, it is contemplated that within a plane 430 (FIG. 8) extending through the apex 384 and extending parallel to the central axis 106 and the second transverse axis 109 (perpendicular to the first transverse axis), the base surface 192 can define a first portion 390 extending between the first base edge 386 and the apex 384 and a second portion 392 extending between the second base edge 388 and the apex 384. In one exemplary aspect, and with reference to FIG. 8, the first portion 390 of the base surface 192 can be positioned at a first selected angle 394 relative to the second transverse axis 109. It is contemplated that the first selected angle 394 can range from about 0° to about 60°, and more preferably be about 30°. In still another exemplary aspect, the second portion 392 of the base surface 192 can be positioned at a second selected angle 396 relative to the second transverse axis 109. It is contemplated that the second selected angle 396 can range from about 0° to about 75°, and more preferably be about 45°. Optionally, in exemplary aspects, it is contemplated that the sum of the first and second selected angles 394, 396 can be about 90°.

As shown in FIG. 10, it is contemplated that within a plane extending through the apex 384 and extending parallel to the central axis 106 and the first transverse axis 107 (perpendicular to the second transverse axis 109), the base surface 192 can be positioned at a selected angle 398 relative to the first transverse axis 107. It is contemplated that the selected angle 398 can range from about 0° to about 30°, extending away from the apex 384 at either a decline or an incline. It is further contemplated that the selected angle 398 is more preferably about 15°.

In exemplary aspects, it is contemplated that, from the apex 384, the base surface 192 can be generally tapered toward the first and second base edges 386, 388. In these aspects, within a first reference plane (not shown) that is parallel to the central axis 106 and that passes through the apex 384 and a reference point on the first base edge 386, the base surface 192 can be positioned at a taper angle relative to the second transverse axis 109. It is contemplated that the taper angle defined by the base surface 192 can increase as the reference point on the first base edge 386 approaches the first inner surface 344A of the first crown portion 334A (and moves away from the first inner surface 344B of the second crown portion 34B). In further aspects, within a second reference plane (not shown) that is parallel to the central axis 106 and that passes through the apex 384 and a reference point on the second base edge 388, the base surface 192 can be positioned at a taper angle relative to the second transverse axis 109. It is contemplated that the taper angle defined by the base surface 192 can increase as the reference point on the second base edge 388 approaches the second inner surface 348B of the second crown portion 334B (and moves away from the second inner surface 348A of the first crown portion 334A). Optionally, in exemplary aspects, the taper angle can range from about 0 degrees to about 45 degrees relative to the second transverse axis 109.

In various embodiments, certain features of the second body 104 are consistent with the drill bit disclosed in U.S. Pat. No. 10,077,609, which issued on Sep. 18, 2019 to Longyear™ Inc., the entire disclosure of which is incorporated by reference herein in its entirety.

EXEMPLARY ASPECTS

In view of the described products, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A drill bit having a central axis, the drill bit comprising: a first body comprising a shank defining an inner bore and a crown having a cutting face, wherein the crown of the first body defines an outer operative circumference and an inner operative circumference; and a second body coupled to the first body and comprising a shank and a crown having a cutting face, wherein the crown of the second body defines an outer operative circumference and is received within the inner operative circumference of the first body, the crown of the second body having an outer diameter, wherein the inner operative circumference of the crown of the first body and the outer operative circumference of the crown of the second body cooperate to define a first volume, wherein the first volume is configured to receive a tubular core sample, wherein the shank of the second body defines a first frustoconical surface, wherein the first frustoconical surface increases in diameter along the central axis in a direction away from the cutting face of the first body, wherein the first frustoconical surface has, along the central axis, a diameter that is sufficiently greater than the outer diameter of the crown of the second body in order to break the tubular core sample into core pieces as the core sample advances against the frustoconical surface, wherein the first body and the second body cooperate to define a second volume that is in communication with the first volume, wherein the first frustoconical surface of the shank of the second body defines at least part of the second volume, and wherein the first body defines at least one conduit between the second volume and the inner bore of the shank of the first body, wherein the at least one conduit is adapted to enable travel of the core pieces from the second volume to the inner bore of the shank of the first body.

Aspect 2: The drill bit of aspect 1, wherein the first body threadedly couples to the second body.

Aspect 3: The drill bit of aspect 1, wherein the first body and the second body are unitarily formed.

Aspect 4: The drill bit of any of aspects 1-3, wherein the second body comprises a base portion, and an interior bore.

Aspect 5: The drill bit of aspect 4, wherein the base portion defines an apex that is radially spaced from the central axis.

Aspect 6: The drill bit of aspect 4 or aspect 5, wherein the second body is configured to form a cylindrical core sample, wherein the second body defines a core receiving space that is configured to receive the cylindrical core sample, wherein the base portion is configured to break apart portions of the cylindrical core sample formed by the second body.

Aspect 7: The drill bit of any of the preceding aspects, wherein in a cross sectional plane containing the central axis, the first frustoconical surface defines a break angle with respect to the central axis, and wherein the break angle is between about five degrees and about twenty degrees.

Aspect 8: The drill bit of any of the preceding aspects, wherein the crown of the first body comprises an outer surface, and wherein the outer surface of the crown of the first body defines at least one longitudinal channel that extends inwardly from the outer operative circumference of the first body.

Aspect 9: The drill bit of aspect 8, wherein the at least one longitudinal channel has a cross section in planes that are perpendicular to the central axis that is sufficient to allow flow of drilling fluid to pump the core pieces in a proximal direction along a drill string.

Aspect 10: The drill bit of any of the preceding aspects, wherein the crown of the inner body comprises first and second crown portions that are spaced apart relative to a first transverse axis that is perpendicular to the longitudinal axis.

Aspect 11: The drill bit of aspect 10, wherein the base portion cooperates with the inner surfaces of the first and second crown portions of the crown to define a continuous slot.

Aspect 12: The drill bit of any of the preceding aspects, wherein the at least one conduit between the second volume and the inner bore of the shank of the first body comprises a plurality of conduits spaced circumferentially about the central axis.

Aspect 13: The drill bit of any of the preceding aspects, wherein the second body further defines a second frustoconical surface that is spaced from the first frustoconical body in a proximal direction, wherein the second frustoconical surface has a decreasing diameter in the proximal direction, and wherein the second frustoconical surface partially defines the second volume.

Aspect 14: The drill bit of aspect 13, wherein the second volume has annular cross sections in planes perpendicular to the central axis, wherein the annular cross sections have respective inner and outer diameters, and wherein respective differences between the respective inner diameters and outer diameters are uniform along the central axis.

Aspect 15: The drill bit of any of the preceding aspects, wherein the first volume has uniform annular cross sections in planes perpendicular to the central axis.

Aspect 16: A method comprising: using a drill bit attached to a drill string, drilling an annular core sample, wherein the drill bit has a central axis and comprises: a first body comprising a shank defining an inner bore and a crown having a cutting face, wherein the crown of the first body defines an outer operative circumference and an inner operative circumference; and a second body coupled to the first body and comprising a shank and a crown having a cutting face, wherein the crown of the second body defines an outer operative circumference, the crown of the second body having an outer diameter, wherein the inner operative circumference of the crown of the first body and the outer operative circumference of the crown of the second body cooperate to define a first volume, wherein the first volume is configured to receive a tubular core sample, wherein the shank of the second body defines a first frustoconical surface, wherein the first frustoconical surface increases in diameter along the central axis in a direction away from the cutting face of the first body, wherein the first frustoconical surface has, along the central axis, a diameter that is sufficiently greater than the outer diameter of the crown of the second body in order to break the tubular core sample into core pieces as the core sample advances against the frustoconical surface, wherein the first body and the second body cooperate to define a second volume that is in communication with the first volume, wherein the first frustoconical surface of the shank of the second body defines at least part of the second volume, and wherein the first body defines at least one conduit between the second volume and the interior bore of the shank of the first body, wherein the at least one conduit is adapted to enable travel of the core pieces from the second volume to the inner bore of the shank of the first body; and advancing the drill but until the first frustoconical surface breaks the core sample into core sample pieces.

Aspect 17: The method of aspect 16, further comprising: providing a drilling fluid to pump the core sample pieces through the at least one conduit and through the drill string.

Aspect 18: The method of aspect 17, wherein providing the drilling fluid comprises pumping drilling fluid around an outer surface of the crown portion of the first body.

Aspect 19: A drill bit having a central axis, the drill bit comprising: a crown having a cutting face and comprising: at least one inner crown portion defining an outer operative circumference, wherein the outer operative circumference of the inner crown portion has a diameter, and at least one outer crown portion defining an outer operative circumference and an inner operative circumference that is spaced radially outward from the outer operative circumference of the at least one inner crown portion, wherein the outer operative circumference of the at least one inner crown portion and the inner operative circumference of the at least one outer crown portion define a first volume therebetween, wherein the first volume is configured to receive a tubular core sample; and a shank having a proximal end that is configured to couple to a drill rod, wherein the shank defines a second volume in communication with the first volume, wherein the second volume comprises a frustoconical inner surface that increases in diameter along the central axis in a direction away from the cutting face, wherein the frustoconical inner surface has, along its length, a diameter that is sufficiently greater than the diameter of the operative circumference of the inner crown portion in order to break the tubular core sample into core pieces, and wherein the shank defines at least one conduit in communication between the second volume, wherein the at least one conduit is adapted to enable travel of the pieces from the second volume to the proximal end of the shank.

Aspect 20: The drill bit of aspect 19, wherein the drill bit comprises an inner portion and an outer portion, wherein the inner portion comprises the at least one inner crown portion, wherein the outer portion comprises the at least one outer crown portion and the shank, wherein the inner portion threadedly couples to the outer portion, and wherein the inner portion defines the frustoconical inner surface of the second volume.

Aspect 21: The drill bit of aspect 20, wherein the inner portion comprises a base portion, and an interior bore, wherein the at least one inner crown portion defines a third volume that is cylindrical and that is configured to receive a cylindrical core sample.

Aspect 22: The drill bit of aspect 21, wherein the base portion defines an apex that is radially spaced from the central axis.

Aspect 23: The drill bit of aspect 21 or aspect 22, wherein the base portion is configured to break off distal portions of the cylindrical core sample.

Aspect 24: The drill bit of any of aspects 19-23, wherein in a cross sectional plane along the central axis, the frustoconical inner surface of the second volume defines a break angle with respect to the central axis, wherein the break angle is between about five degrees and about twenty degrees.

Aspect 25: The drill bit of any of aspects 19-24, wherein the operative circumference of the at least one crown portion is greater than the diameter of the shank and defines at least one longitudinal channel that extends inwardly from the operative circumference.

Aspect 26: The drill bit of aspect 25, wherein the at least one longitudinal channel has a cross section in planes that are perpendicular to the central axis that is sufficient to allow flow of drilling fluid that can pump the core pieces up a drill string.

Aspect 27: The drill bit of any of aspects 21-26, wherein the at least one inner crown portion comprises first and second crown portions spaced apart relative to a first transverse axis that is perpendicular to the longitudinal axis.

Aspect 28: The drill bit of aspect 27, wherein the base portion cooperates with the inner surfaces of the first and second crown portions of the crown to define a continuous slot.

Aspect 29: The drill bit of any of aspects 19-28, wherein the at least one conduit in communication between the second volume that is adapted to enable travel of the pieces from the second volume to the proximal end of the shank comprises a plurality of conduits spaced circumferentially about the central axis.

Aspect 30: The drill bit of any of aspects 19-29, wherein the cutting face comprises at least one cutting face defined by the at least one inner crown portion and at least one cutting face defined by the at least one outer crown portion.

Although the foregoing invention has been described in some detail by way of illustration and example for purposes of clarity of understanding, certain changes and modifications may be practiced within the scope of the appended claims.

What is claimed is:

1. A drill bit having a central axis, the drill bit comprising:

a crown having a cutting face and comprising:

at least one inner crown portion defining an outer operative circumference, wherein the outer operative circumference of the inner crown portion has a diameter; and at least one outer crown portion defining an outer operative circumference and an inner operative circumference that is spaced radially outward from the outer operative circumference of the at least one inner crown portion, wherein the outer operative circumference of the at least one inner crown portion and the inner operative circumference of the at least one outer crown portion define a first volume therebetween, wherein the first volume is configured to receive a tubular core sample; and a shank having a proximal end that is configured to couple to a drill rod, wherein the shank comprises an outer shank portion and an inner shank portion, the outer shank portion being secured to the at least one outer crown portion, the inner shank portion being secured to the at least one inner crown portion, the shank defining a second volume in communication with the first volume, the second volume being defined between the inner and outer shank portions, wherein the inner shank portion has an outer diameter and a first frustoconical outer surface, wherein the outer diameter of the inner shank portion along the first frustoconical outer surface increases moving along the central axis in a direction away from the cutting face, wherein the outer diameter of the inner shank portion is sufficiently greater than the diameter of the operative circumference of the inner crown portion to break the tubular core sample into core sample pieces, and wherein the shank defines at least one conduit in communication with the second volume, wherein the at least one conduit is adapted to enable travel of the core sample pieces from the second volume to the proximal end of the shank.

2. The drill bit of claim 1, wherein the drill bit comprises an inner portion and an outer portion, wherein the inner portion comprises the at least one inner crown portion and the inner shank portion, and wherein the outer portion comprises the at least one outer crown portion and the outer shank portion.

3. The drill bit of claim 2, wherein the inner portion comprises a base portion, and an interior bore, wherein the at least one inner crown portion defines a third volume that is cylindrical and that is configured to receive a cylindrical core sample.

4. The drill bit of claim 3, wherein the base portion defines an apex that is radially spaced from the central axis.

5. The drill bit of claim 3, wherein the base portion is configured to break off distal portions of the cylindrical core sample.

6. The drill bit of any of claim 3, wherein the at least one inner crown portion comprises first and second crown portions spaced apart relative to a first transverse axis that is perpendicular to the central axis.

7. The drill bit of claim 6, wherein the base portion cooperates with the inner surfaces of the first and second crown portions of the crown to define a continuous slot.

8. The drill bit of claim 1, wherein in a cross sectional plane along the central axis, the first frustoconical outer surface of the inner shank portion defines a break angle with respect to the central axis, wherein the break angle is between about five degrees and about twenty degrees.

9. The drill bit of claim 1, wherein the outer operative circumference of the at least one outer crown portion is greater than an outer diameter of the outer shank portion and defines at least one longitudinal channel that extends inwardly from the operative circumference.

10. The drill bit of claim 9, wherein the at least one longitudinal channel has a cross section in planes that are perpendicular to the central axis that is sufficient to allow flow of drilling fluid that can pump the core sample pieces up a drill string.

11. The drill bit of claim 1, wherein the at least one conduit in communication with the second volume that is adapted to enable travel of the core sample pieces from the second volume to the proximal end of the shank comprises a plurality of conduits spaced circumferentially about the central axis.

12. The drill bit of claim 1, wherein the cutting face comprises at least one cutting face defined by the at least one inner crown portion and at least one cutting face defined by the at least one outer crown portion.

13. A method comprising:

using a drill bit attached to a drill string, drilling a tubular core sample, wherein the drill bit comprises:

a crown having a cutting face and comprising:

at least one inner crown portion defining an outer operative circumference, wherein the outer operative circumference of the inner crown portion has a diameter; and at least one outer crown portion defining an outer operative circumference and an inner operative circumference that is spaced radially outward from the outer operative circumference of the at least one inner crown portion, wherein the outer operative circumference of the at least one inner crown portion and the inner operative circumference of the at least one outer crown portion define a first volume therebetween, wherein the first volume is configured to receive the tubular core sample; and a shank having a proximal end that is configured to couple to a drill rod, wherein the shank comprises an outer shank portion and an inner shank portion, the outer shank portion being secured to the at least one outer crown portion, the inner shank portion being secured to the at least one inner crown portion, the shank defining a second volume in communication with the first volume, the second volume being defined between the inner and outer shank portions, wherein the inner shank portion has an outer diameter and a first frustoconical outer surface, wherein the outer diameter of the inner shank portion along the first frustoconical outer surface increases moving along the central axis in a direction away from the cutting face, wherein the outer diameter of the inner shank portion is sufficiently greater than the diameter of the operative circumference of the inner crown portion to break the tubular core sample into core sample pieces, and wherein the shank defines at least one conduit in communication with the second volume, wherein the at least one conduit is adapted to enable travel of the core sample pieces from the second volume to the proximal end of the shank; and advancing the drill within a formation, wherein the first frustoconical outer surface of the inner shank portion breaks the tubular core sample into the core sample pieces.

14. The method of claim 13, further comprising:

providing a drilling fluid to pump the core sample pieces through the at least one conduit and through the drill string.

15. The method of claim 14, wherein providing the drilling fluid comprises pumping drilling fluid around an outer surface of the outer crown portion.

* * * * *